US009217434B2

(12) United States Patent
Han et al.

(10) Patent No.: US 9,217,434 B2
(45) Date of Patent: Dec. 22, 2015

(54) COMPRESSOR HAVING DRIVE SHAFT WITH FLUID PASSAGES

(75) Inventors: YanChun Han, Jiangsu (CN); Ruimin Zheng, Jiangsu (CN); Michael M. Perevozchikov, Tipp City, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 247 days.

(21) Appl. No.: 13/445,611

(22) Filed: Apr. 12, 2012

(65) Prior Publication Data

US 2012/0263609 A1 Oct. 18, 2012

(30) Foreign Application Priority Data

Apr. 15, 2011 (CN) ..... 2011 1 0098615
Apr. 15, 2011 (CN) ..... 2011 2 0116205 U

(51) Int. Cl.
*F04C 29/02* (2006.01)
*F04C 15/00* (2006.01)
(Continued)

(52) U.S. Cl.
CPC ..... *F04C 29/023* (2013.01); *F04B 39/02* (2013.01); *F04B 39/0253* (2013.01); *F04B 39/06* (2013.01); *F04B 53/006* (2013.01);
(Continued)

(58) Field of Classification Search
CPC ..... F04C 29/02; F04C 29/023; F04C 29/026; F04C 29/028; F04C 15/0088; F04C 15/0096; F04C 29/04; F04C 18/02; F04C 18/0207; F04C 23/008; F04C 2240/603; F04B 39/06; F04B 39/02; F04B 53/08; F04B 53/006; F04B 53/008; F04B 39/0246; F04B 39/0253
USPC ..... 417/902, 349, 357, 366, 368, 410.5
See application file for complete search history.

(56) References Cited

U.S. PATENT DOCUMENTS 3,736,076 A * 5/1973 Ayling ..... 417/372
4,502,852 A * 3/1985 Hazaki ..... 418/55.6
(Continued)

FOREIGN PATENT DOCUMENTS

EP 1 055 820 * 11/2000 ..... F04C 18/02
EP 1055820 A1 11/2000
(Continued)

OTHER PUBLICATIONS

International Search Report regarding Application No. PCT/US2012/033468, mailed Oct. 24, 2012.
(Continued)

*Primary Examiner* — Bryan Lettman
*Assistant Examiner* — Timothy P Solak
(74) *Attorney, Agent, or Firm* — Harness, Dickey & Pierce, P.L.C.

(57) ABSTRACT

A compressor may include a shell, a compression mechanism supported within the shell, a drive shaft engaged with the compression mechanism and a motor. The drive shaft may define first and second passages extending axially within the drive shaft and a third passage extending radially through an outer circumferential surface of the drive shaft and in communication with the second passage. The drive shaft may define an axially extending wall separating the first and second passages. The motor may include a rotor fixed to the drive shaft and a stator supported within the shell. The third passage may be adapted to provide oil to the stator during compressor operation to cool the stator.

12 Claims, 5 Drawing Sheets

(51) Int. Cl.

| | |
|---|---|
| ***F04C 18/02*** | (2006.01) |
| ***F04C 23/00*** | (2006.01) |
| ***F04B 39/02*** | (2006.01) |
| ***F04B 53/06*** | (2006.01) |
| ***F04B 53/00*** | (2006.01) |
| ***F04B 39/06*** | (2006.01) |

(52) U.S. Cl.

CPC ..... *F04C15/0088* (2013.01); *F04C 18/0215* (2013.01); *F04C 23/008* (2013.01); *F04C 2240/603* (2013.01)

(56) References Cited

U.S. PATENT DOCUMENTS

| | | | | | |
|---|---|---|---|---|---|
| 4,565,503 | A | | 1/1986 | Wise | |
| 4,592,703 | A | * | 6/1986 | Inaba et al. | 417/366 |
| 4,621,993 | A | | 11/1986 | Nakamura et al. | |
| 4,637,786 | A | * | 1/1987 | Matoba et al. | 418/55.3 |
| 4,655,697 | A | * | 4/1987 | Nakamura et al. | 418/55.4 |
| 5,295,808 | A | * | 3/1994 | Machida et al. | 417/366 |
| 5,810,573 | A | | 9/1998 | Mitsunaga et al. | |
| 6,102,160 | A | * | 8/2000 | Cornelius | 184/6.16 |
| 6,494,696 | B2 | * | 12/2002 | Terai et al. | 418/55.6 |
| 6,715,999 | B2 | * | 4/2004 | Ancel et al. | 417/310 |
| 7,481,632 | B1 | | 1/2009 | Sun | |
| 2004/0258542 | A1 | * | 12/2004 | Wiertz et al. | 417/410.5 |
| 2007/0243082 | A1 | * | 10/2007 | Fields et al. | 417/349 |

FOREIGN PATENT DOCUMENTS

| | | | |
|---|---|---|---|
| JP | 03003991 | A | 1/1991 |
| JP | 05164079 | A | 6/1993 |

OTHER PUBLICATIONS

Written Opinion of the International Searching Authority regarding Application No. PCT/US2012/033468, mailed Oct. 24, 2012.

English translation of Chinese Utility Model Application No. 201120116205.8, filed Apr. 15, 2011. Translation provided by Unitalen Attorneys at Law.

English translation of Chinese Patent Application for Invention No. 201110098615.9, filed Apr. 15, 2011. Translation provided by Unitalen Attorneys at Law.

Second Office Action regarding China Application No. 20111009861539 dated Jan. 4, 2015. Translation provided by Unitalen Attorneys at Law.

* cited by examiner

COMPRESSOR HAVING DRIVE SHAFT WITH FLUID PASSAGES

CROSS-REFERENCE TO RELATED APPLICATIONS

This application claims the benefit and priority of Chinese Application Nos. 2011201162058, filed Apr. 15, 2011 and 2011100986159, filed Apr. 15, 2011. The entire disclosure of each of the above applications is incorporated herein by reference.

FIELD

The present disclosure relates to compressor motor cooling.

BACKGROUND

This section provides background information related to the present disclosure which is not necessarily prior art.

During operation a compressor drive mechanism may generate heat. In order to cool the motor of the drive mechanism, a portion of the refrigerant gas supplied to the compressor at a suction pressure may be directed toward the motor.

SUMMARY

This section provides a general summary of the disclosure, and is not a comprehensive disclosure of its full scope or all of its features.

A compressor may include a shell, a compression mechanism supported within the shell, a drive shaft engaged with the compression mechanism and a motor. The drive shaft may define first and second passages extending axially within the drive shaft and a third passage extending radially through an outer circumferential surface of the drive shaft and in communication with the second passage. The drive shaft may define an axially extending wall separating the first and second passages. The motor may include a rotor fixed to the drive shaft and a stator supported within the shell. The third passage may be adapted to provide oil to the stator during compressor operation to cool the stator.

A third passage may include an oil outlet axially aligned with a lower end of the stator. The second passage may terminate within the drive shaft at an axial location within the drive shaft between the lower end of the stator and an upper end of the stator.

The drive shaft may include a first axial end defining an oil supply passage in communication with the first and second passages. The first and second passages may extend axially outward from the oil supply passage. The first passage may extend from the oil supply passage to a second axial end of the drive shaft.

In another arrangement, a third passage may include an oil outlet axially aligned with an upper end of the stator. The third passage may intersect the first and second passages.

A compressor may additionally include a counterweight fixed to the drive shaft at a location circumferentially offset from an oil outlet defined by the third passage. The compressor may additionally include a suction fitting coupled to the shell at a location between an axial midpoint on the stator and the compression mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The present teachings are suitable for incorporation in many different types of scroll and rotary compressors, including hermetic machines, open drive machines and non-hermetic machines. For exemplary purposes, a compressor 100 is shown as a hermetic scroll refrigerant-compressor of the low-side type, i.e., where the motor and compressor are cooled by suction gas in the hermetic shell, as illustrated in the vertical section shown in FIG. 1.

Figure 1:
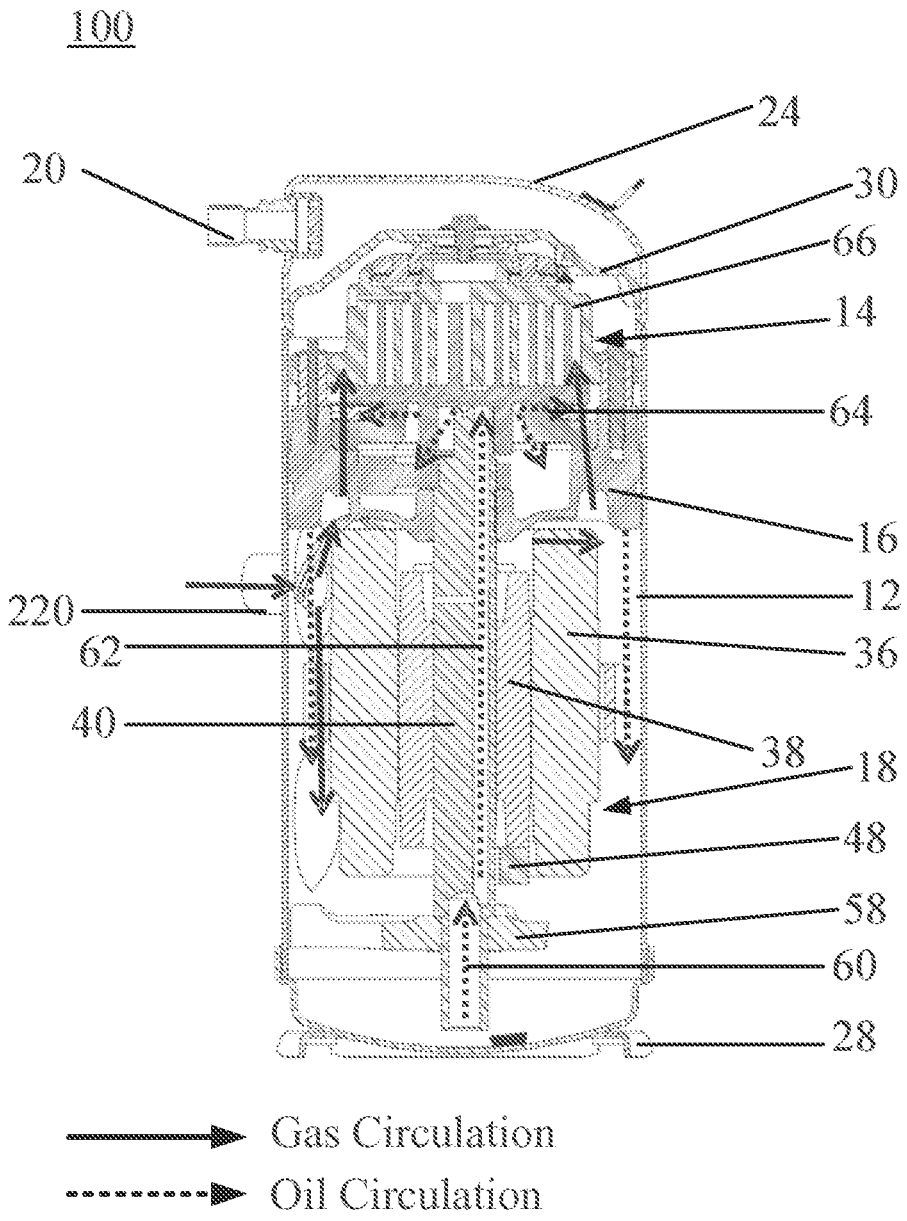
Figure 1 (Prior Art)
FIG. 1 is a section view of an example scroll compressor.

As shown in FIG. 1, the scroll compressor 100 may include a cylindrical sealed shell 12, a compression mechanism 14, a main bearing housing 16, a drive mechanism 18, an exhaust fitting 20, and a suction fitting 220. The sealed shell 12 houses the compression mechanism 14 and the drive mechanism 18. The suction fitting 220 is provided on the shell 12 for receiving low pressure gaseous refrigerant. An end cap 24 is located at the end of the shell 12. The exhaust fitting 20 is provided on the end cap 24 for discharging the compressed refrigerant. A muffler plate 30 may be located between the end cap 24 and the shell 12 and may extend laterally relative to the axial direction of the shell 12 (extending along the substantially horizontal direction in FIG. 1) between the shell 12 and the end cap 24. The muffler plate 30 may separate a high pressure region and a low pressure region of the compressor 10. The volume between the end cap 24 and the muffler plate 30 may define the high pressure region and form a discharge muffler. The volume between the muffler plate 30 and the shell 12 may define the low pressure region. A base 28 may be secured at the bottom of the shell 12 for mounting the compressor 10 onto a system rack.

The compression mechanism 14 may include a non-orbiting scroll 66 and an orbiting scroll 64 in meshing engagement with each other. The drive mechanism 18 may include a stator 36, a rotor 38, and a drive shaft 40. The drive mechanism 18 may be engaged with the compression mechanism 14 to drive the compression mechanism 14. The stator 36 may include a winding on the upper part of the stator 36 (upper stator winding) and a winding on the lower part of the stator 36 (lower stator winding). The stator 36 may be fixedly connected with the shell 12. The suction fitting 220 may be coupled to the shell 12 at a location between an axial midpoint of the stator 36 and the compression mechanism 14.

The rotor 38 may be located in the stator 36 and connected to the drive shaft 40 for rotation with the drive shaft 40 within the stator 36. The compression mechanism 14 may be axially supported by the main bearing housing 16. One end of the drive shaft 40 may be supported via a sliding bearing by the main bearing housing 16 and the other end of the drive shaft 40 may be supported by a lower bearing housing 58. The main bearing housing 16 may be fixedly connected to the shell 12.

The rotor 38 may be press fit on the drive shaft 40 and may drive rotation of the drive shaft 40. A counter weight 48 may be mounted on the rotor 38. The drive shaft 40 may include an axially extending body defining a supply passage 60 at the lower end thereof. The supply passage 60 may communicate with the first passage 62 extending axially within the drive shaft 40. The first passage 62 may extend in an outward axial and radial direction from the supply passage 60. The first passage 62 may define a smaller diameter than the supply passage 60 and may extend to the upper end of the drive shaft 40. The lower interior portion of the shell 12 may be filled with lubricating oil and the supply passage 60 may provide pump action in conjunction with the first passage 62 to distribute the lubricating oil to various portions of the compressor 10.

An alternate drive shaft 400 may be used in the compressor 100 and may include a motor cooling supply passage 5 in addition to the features discussed above for the drive shaft 40. The motor cooling supply passage 5 may include second and third passages 1, 2. The second passage 1 may be in communication with the supply passage 60, extend in a generally axial direction within the drive shaft 400, and may terminate within the drive shaft 400. The third passage 2 may extend radially through an outer circumferential wall of the drive shaft 400 and intersect the second passage 1. The first passage 62 may provide oil located in a lower part of the shell to the compression mechanism 14 for lubrication when the drive shaft 400 is rotating. The second passage 1 may provide oil to the third passage 2 to spray oil located in the lower part of the shell 12 onto the lower stator winding when the drive shaft 400 is rotating. The extent of the third passage 2 in the radial direction of the drive shaft 400 may accelerate the oil flowing from the second passage 1 to the third passage 2 to increase the amount of oil spraying onto the lower stator winding per unit of time, further improving the effect of cooling down of the lower stator winding.

In order to further increase the radial velocity of the oil flowing through the third passage 2, a spraying tube (not shown) may be further provided on the surface of the drive shaft 400. The spraying tube may be connected to the drive shaft 400 at the outlet 8 of the third passage 2 such that the spraying tube forms a part of the third passage 2. Thus, due to the presence of the spraying tube, the effective length of the third passage 2 in the radial direction of the drive shaft 400 may be increased.

In general, the temperature of the oil at the bottom of the shell 12 may be lower than the temperature of the lower stator winding. For example, the temperature difference between the oil and the lower stator winding may be approximately forty-five degrees Fahrenheit. Thus, the capacity of the oil for cooling the lower stator winding may be enhanced.

Figure 2:
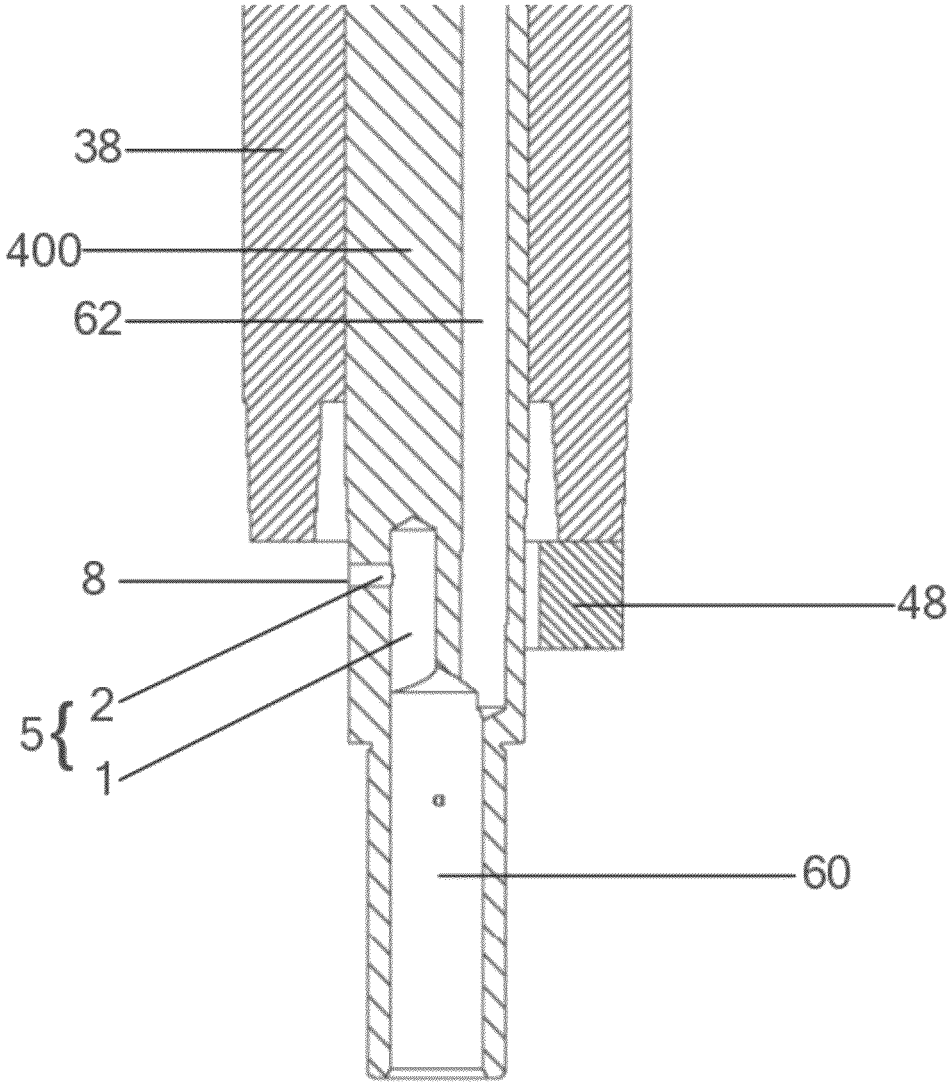
FIG. 2 is a fragmentary section view of a compressor drive shaft according to the present disclosure.
Figure 3:
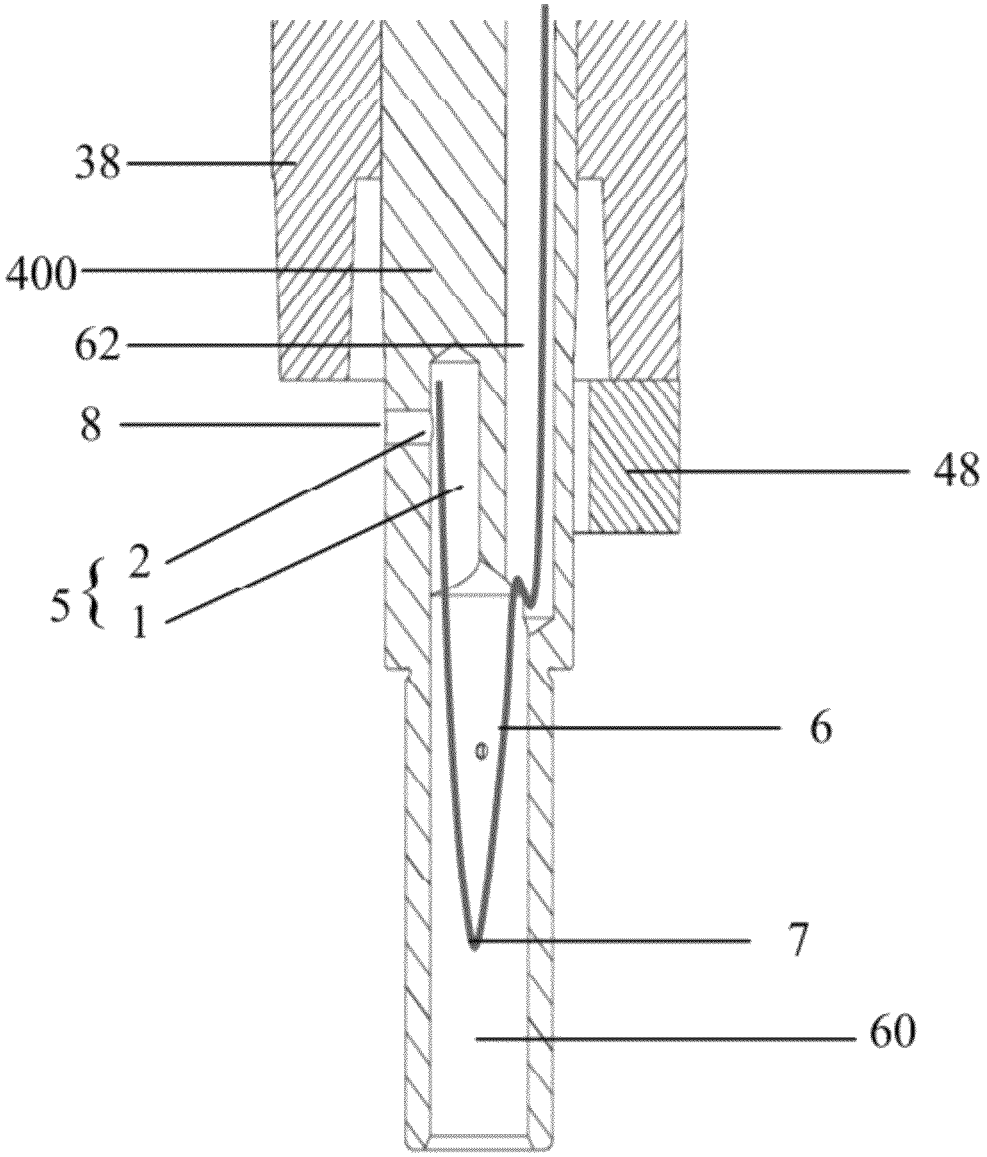
FIG. 3 is an additional fragmentary section view of the compressor drive shaft shown in FIG. 2.

The first passage 62 and the second passage 1 may be separated from each other in the drive shaft 400 by an axially extending wall defined by the body of the drive shaft 400. As shown in FIGS. 2 and 3, the second passage 1 may be opposite to the first passage 62 with respect to the center line of the drive shaft 400.

When the drive shaft 400 is rotating, the oil within the drive shaft 400 is accelerated by centrifugal force. As shown in FIG. 3, due to baffling of the inner walls of the first passage 62 and the second passage 1 in the drive shaft 400, the direction of the velocity of the oil is changed from the radial direction to the axial direction, forming the parabolic shaped oil level 6 with rotation of the drive shaft 400. Thus, the oil within the drive shaft 400 may ultimately flow out through the first passage 62 and the second passage 1.

The axial height of the third passage 2 may be higher than that of the vertex 7 of the parabolic shaped oil level 6 to ensure that oil flow through the second passage 1 will not influence the normal operation of the first passage 62. Increasing the length of the third passage 2 in the radial direction of the drive shaft 400 may increase the velocity of the oil flowing in the third passage 2. When the velocity of the oil increases, the amount of oil spraying onto the lower stator winding per unit of time will be increased, further improving the effect of cooling down of the lower stator winding.

Figure 4:
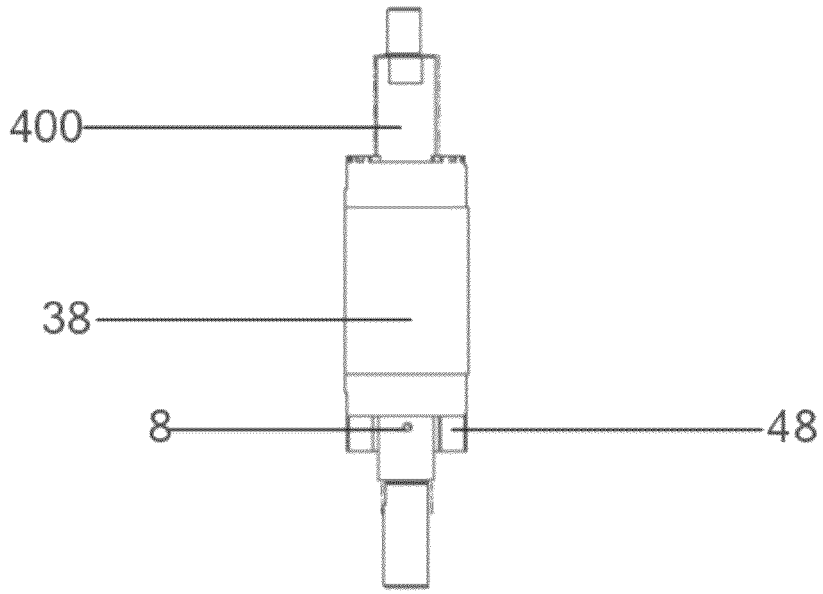
FIG. 4 is an illustration of the drive shaft from FIGS. 2 and 3 and a motor assembly.
Figure 5:
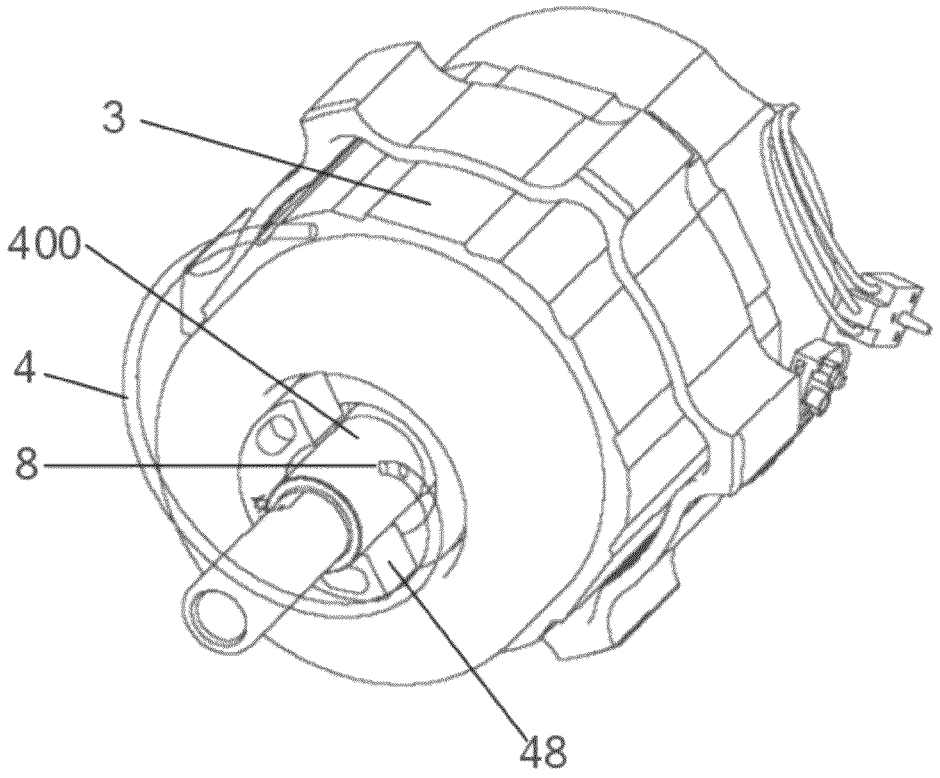
FIG. 5 is an additional illustration of the drive shaft and motor assembly from FIG. 4.

The location and diameter of the outlet of the third passage 2 may prevent the oil sprayed from the third passage 2 from rushing onto the counter weight 48 nearby and ensure that the oil is sprayed onto the lower stator winding. As shown in FIG. 4, the outlet 8 of the third passage 2 may be located opposite to the counter weight 48 mounted on the drive shaft 400 with respect to the center line of the drive shaft 400. As shown in FIG. 5, when the drive shaft 400 is rotating, the oil 4 sprayed from the third passage 2 may avoid the counter weight 48 and spray onto the lower stator winding 3. The outlet 8 of the third passage 2 may face towards the lower stator winding 3.

Figure 6:
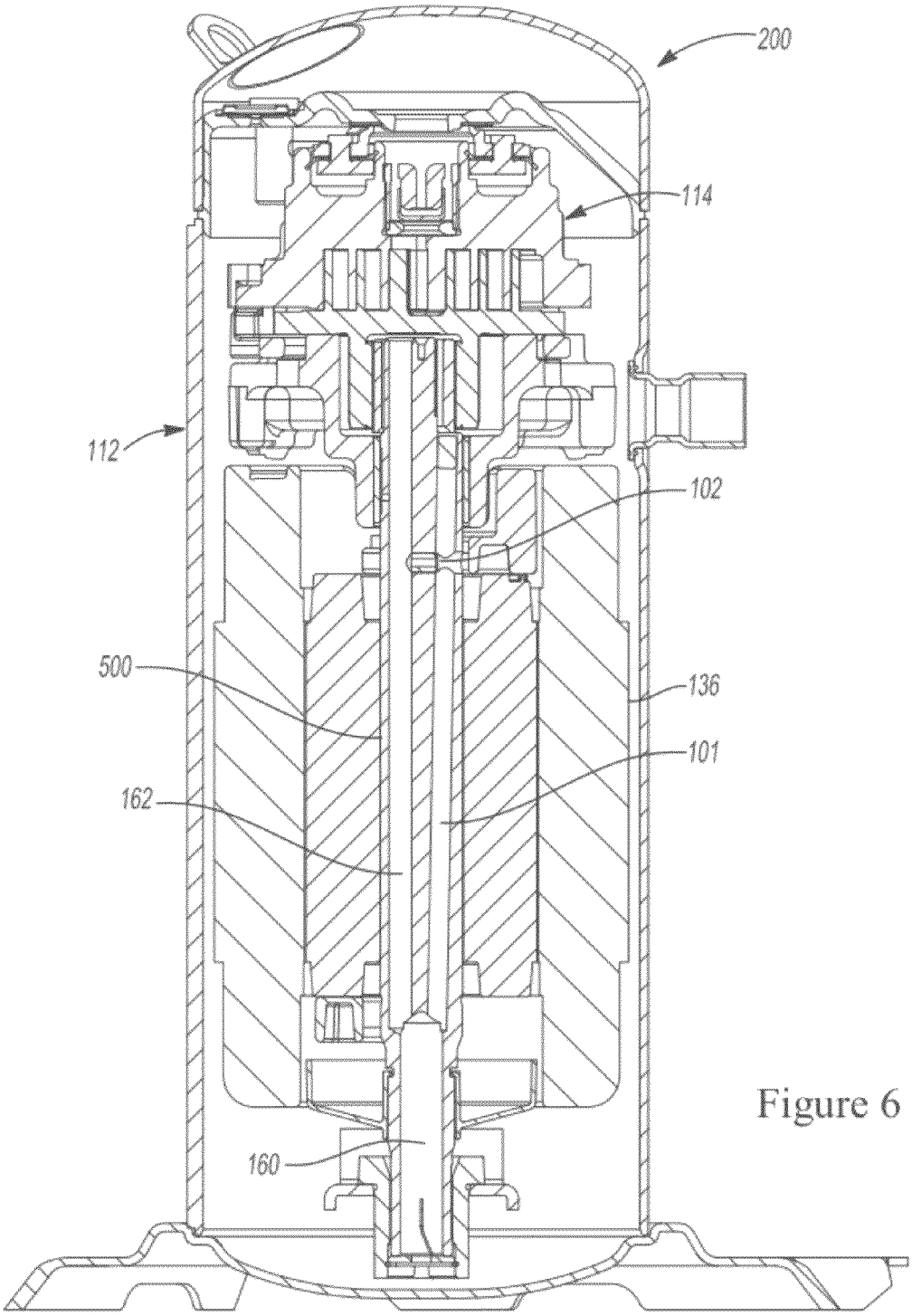
FIG. 6 is a section view of a compressor including an alternate drive shaft according to the present disclosure.

In an alternate arrangement shown in FIG. 6, an alternate drive shaft 500 may be used in place of drive shaft 40 or 400. The compressor 200 may be generally similar to the compressor 100 and will not be discussed in detail with the understanding that the description of compressor 100 applies equally, with the exceptions noted.

The drive shaft 500 may include a supply passage 160 and a first passage 162. The second passage 101 may extend axially within the drive shaft 500 from the supply passage 160 toward the compression mechanism 114 to a location at or beyond an upper end of the stator 136. The third passage 102 may extend radially through an outer circumferential wall of the drive shaft 500 and intersect the second passage 101. The third passage 102 may additionally extend radially inward and intersect the first passage 162.

The second passage 101 may provide oil to the third passage 102 to spray oil located in the lower part of the shell 112 onto the upper stator winding when the drive shaft 500 is rotating. The extent of the third passage 102 in the radial direction of the drive shaft 500 may accelerate the oil flowing from the second passage 101 to the third passage 102 to increase the amount of oil spraying onto the upper stator winding per unit of time, further improving the effect of cooling down of the upper stator winding.

What is claimed is:

1. A compressor comprising:

a shell;

a compression mechanism supported within said shell;

a drive shaft engaged with said compression mechanism and defining first and second passages extending axially within said drive shaft and a third passage extending radially through an outer circumferential surface of said drive shaft and in communication with said first and second passages, said drive shaft defining an axially extending wall separating said first and second passages, said drive shaft including a supply passage extending axially through a first axial end of said drive shaft, said first and second passages fluidly communicating with said supply passage and extending axially from said supply passage; and a motor including a rotor fixed to said drive shaft and a stator supported within said shell, said stator including an upper stator winding and a lower stator winding, said third passage adapted to fling oil onto said upper stator winding during compressor operation to cool said stator, wherein said third passage is aligned in an axial direction with a portion of said upper stator winding, and wherein said oil is travelling radially outwardly when said oil contacts said upper stator winding.

2. The compressor of claim 1, wherein said second passage terminates within said drive shaft at a location within said drive shaft that is aligned in an axial direction with a portion of said stator.

3. The compressor of claim 1, wherein said first passage extends from said oil supply passage to a second axial end of said drive shaft.

4. The compressor of claim 1, wherein said third passage includes an oil outlet axially aligned with said upper stator winding.

5. The compressor of claim 4, wherein said third passage intersects said first and second passages.

6. The compressor of claim 1, further comprising a counterweight fixed to said drive shaft at a location circumferentially offset from an oil outlet defined by said third passage.

7. The compressor of claim 1, wherein the third passage is disposed axially below a lower axial end of a main bearing housing that supports the drive shaft.

8. The compressor of claim 7, wherein the third passage is disposed axially above the rotor.

9. A compressor comprising:

a shell;

a compression mechanism supported within said shell and including an orbiting scroll and a non-orbiting scroll;

a drive shaft engaged with said orbiting scroll and defining first and second passages extending axially within said drive shaft and a third passage extending radially through an outer circumferential surface of said drive shaft and in communication with said first and second passages, said drive shaft defining an axially extending wall separating said first and second passages, said drive shaft including a supply passage extending axially through a first axial end of said drive shaft, said first and second passages fluidly communicating with said supply passage and extending axially from said supply passage; and a motor including a rotor fixed to said drive shaft and a stator supported within said shell, said stator including an upper stator winding and a lower stator winding, said third passage adapted to fling oil onto said upper stator winding during compressor operation to cool said stator, wherein said oil that is flung onto said upper stator winding is shielded from said orbiting scroll as said oil travels from said third passage to said upper stator winding.

10. The compressor of claim 9, wherein said third passage is aligned in an axial direction with a portion of said upper stator winding, and wherein said oil is travelling radially outwardly when said oil contacts said upper stator winding.

11. The compressor of claim 10, wherein said third passage is disposed axially above said rotor.

12. The compressor of claim 11, wherein said third passage is disposed axially below a lower axial end of a main bearing housing that supports said drive shaft.

* * * * *